US007931082B2

(12) United States Patent
Surjaatmadja

(10) Patent No.: US 7,931,082 B2
(45) **Date of Patent: *Apr. 26, 2011**

(54) METHOD AND SYSTEM FOR CENTRALIZED WELL TREATMENT

(75) Inventor: Jim B. Surjaatmadja, Duncan, OK (US)

(73) Assignee: Halliburton Energy Services Inc.,, Duncan, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/873,186

(22) Filed: Oct. 16, 2007

(65) Prior Publication Data

US 2009/0095482 A1 Apr. 16, 2009

(51) Int. Cl.
*E21B 43/16* (2006.01)

(52) U.S. Cl. ..... 166/268; 166/52; 166/90.1; 166/279; 166/305.1

(58) Field of Classification Search ..... None
See application file for complete search history.

(56) References Cited

U.S. PATENT DOCUMENTS

| | | | | |
|---|---|---|---|---|
| 2,758,653 A | | 8/1956 | Desbrow | |
| 2,953,460 A | | 9/1960 | Baker | |
| 2,980,291 A | | 4/1961 | Schuerger | |
| 3,062,286 A | | 11/1962 | Wyllie | |
| 3,455,391 A | | 7/1969 | Matthews | |
| 3,537,529 A | | 11/1970 | Timmerman | |
| 3,556,218 A | * | 1/1971 | Talley et al. | 166/265 |
| 3,578,080 A | * | 5/1971 | Closmann | 166/248 |
| 3,682,246 A | | 8/1972 | Closmann | |
| 3,822,747 A | | 7/1974 | Maguire | |
| 3,933,205 A | | 1/1976 | Kiel | |
| 4,050,529 A | | 9/1977 | Tagirov et al. | |
| 4,137,970 A | | 2/1979 | Laflin et al. | |
| 4,209,278 A | | 6/1980 | Cooper et al. | |
| 4,265,266 A | | 5/1981 | Kierbow et al. | |
| 4,305,463 A | * | 12/1981 | Zakiewicz | 166/245 |
| 4,353,482 A | | 10/1982 | Tomlinson et al. | |
| 4,409,927 A | | 10/1983 | Loesch et al. | |

(Continued)

FOREIGN PATENT DOCUMENTS

EP 0124251 11/1984

(Continued)

OTHER PUBLICATIONS

U.S. Appl. No. 11/545,749, filed Oct. 10, 2006, Surjaatmadja.

(Continued)

*Primary Examiner* — Zakiya W. Bates
(74) *Attorney, Agent, or Firm* — John W. Wustenberg; Baker Botts LLP

(57) ABSTRACT

A method of servicing multiple well locations from a central location that includes the steps of configuring a central location for distribution of well development task fluids to centralized service factories through fluid lines; preparing the treatment fluids at the centralized service factories; and treating wells with the treatment fluids according to well development tasks associated with each well. A system for centralized well treatment operations that includes a centralized well treatment center which pumps well development task fluids to centralized service factories; a plurality of systems with well development mechanisms; a first connection and second connection between a well and the centralized service factories, wherein the connections are directed to flowing and recovering treatment fluids respectively; a third and fourth connection between another well and the well treatment factory, wherein the connections are directed to flowing and recovering treatment fluids respectively.

31 Claims, 7 Drawing Sheets

U.S. PATENT DOCUMENTS

| | | | | |
|---|---|---|---|---|
| 4,410,106 | A | 10/1983 | Kierbow et al. | |
| 4,427,133 | A | 1/1984 | Kierbow et al. | |
| 4,635,723 | A * | 1/1987 | Spivey | 166/310 |
| 4,701,095 | A | 10/1987 | Berryman et al. | |
| 4,715,721 | A | 12/1987 | Walker et al. | |
| 4,724,905 | A | 2/1988 | Uhri | |
| 4,733,567 | A | 3/1988 | Serata | |
| 4,830,106 | A | 5/1989 | Uhri | |
| 4,845,981 | A | 7/1989 | Pearson | |
| 4,850,750 | A | 7/1989 | Cogbill et al. | |
| 4,974,675 | A | 12/1990 | Austin et al. | |
| 5,014,218 | A | 5/1991 | Crain et al. | |
| 5,111,881 | A | 5/1992 | Soliman et al. | |
| 5,228,510 | A | 7/1993 | Jennings, Jr. et al. | |
| 5,245,548 | A | 9/1993 | Kuan | |
| 5,281,023 | A | 1/1994 | Cedillo et al. | 366/17 |
| 5,365,435 | A | 11/1994 | Stephenson | 700/265 |
| 5,417,283 | A | 5/1995 | Ejiogu et al. | |
| 5,494,103 | A | 2/1996 | Surjaatmadja et al. | |
| 5,499,678 | A | 3/1996 | Surjaatmadja et al. | |
| 5,515,920 | A * | 5/1996 | Luk et al. | 166/280.1 |
| 5,574,218 | A | 11/1996 | Withers | |
| 5,659,480 | A | 8/1997 | Anderson et al. | |
| 6,120,175 | A | 9/2000 | Tewell | |
| 6,193,402 | B1 | 2/2001 | Grimland et al. | |
| 6,236,894 | B1 * | 5/2001 | Stoisits et al. | 700/28 |
| 6,394,184 | B2 | 5/2002 | Tolman et al. | 166/281 |
| 6,575,247 | B2 | 6/2003 | Tolman et al. | |
| 6,644,844 | B2 | 11/2003 | Neal et al. | |
| 6,729,394 | B1 | 5/2004 | Hassan et al. | |
| 6,935,424 | B2 | 8/2005 | Lehman | |
| 6,991,037 | B2 | 1/2006 | Hocking | |
| 7,036,587 | B2 | 5/2006 | Munoz, Jr. et al. | |
| 7,143,832 | B2 | 12/2006 | Freyer | |
| 7,225,869 | B2 | 6/2007 | Willett et al. | |
| 7,243,726 | B2 | 7/2007 | Ohmer | |
| 7,367,411 | B2 * | 5/2008 | Leuchtenberg | 175/48 |
| 7,391,675 | B2 | 6/2008 | Drew | |
| 7,431,090 | B2 | 10/2008 | Surjaatmadja et al. | |
| 7,445,045 | B2 | 11/2008 | East, Jr. et al. | |
| 7,711,487 | B2 | 5/2010 | Surjaatmadja | |
| 2002/0125011 | A1 | 9/2002 | Snider et al. | |
| 2003/0050758 | A1 | 3/2003 | Soliman et al. | |
| 2003/0141064 | A1 | 7/2003 | Roberson, Jr. | |
| 2004/0020662 | A1 | 2/2004 | Freyer | 166/387 |
| 2005/0121196 | A1 | 6/2005 | East, Jr. et al. | |
| 2005/0211439 | A1 | 9/2005 | Willett et al. | |
| 2006/0081412 | A1 | 4/2006 | Wright et al. | |
| 2006/0161358 | A1 | 7/2006 | Dykstra et al. | |
| 2006/0185848 | A1 | 8/2006 | Surjaatmadja et al. | |
| 2006/0243437 | A1 | 11/2006 | Albers et al. | |
| 2006/0289167 | A1 | 12/2006 | Surjaatmadja et al. | |
| 2007/0116546 | A1 | 5/2007 | Dearing | |
| 2007/0125543 | A1 | 6/2007 | McNeel et al. | 166/308.3 |
| 2007/0125544 | A1 | 6/2007 | Robinson et al. | 166/308.3 |
| 2007/0153622 | A1 | 7/2007 | Dykstra et al. | |
| 2007/0153623 | A1 | 7/2007 | Dykstra et al. | |
| 2007/0153624 | A1 | 7/2007 | Dykstra et al. | |
| 2007/0171765 | A1 | 7/2007 | Dykstra et al. | |
| 2007/0201305 | A1 | 8/2007 | Heilman et al. | |
| 2008/0083531 | A1 | 4/2008 | Surjaatmadja | |
| 2008/0083532 | A1 | 4/2008 | Surjaatmadja | 166/250.1 |
| 2008/0083538 | A1 | 4/2008 | Soliman | |
| 2008/0236818 | A1 | 10/2008 | Dykstra | |
| 2009/0050311 | A1 | 2/2009 | Crawford | |
| 2009/0114392 | A1 * | 5/2009 | Tolman et al. | 166/305.1 |
| 2009/0194273 | A1 | 8/2009 | Surjaatmadja | |

FOREIGN PATENT DOCUMENTS

| | | | |
|---|---|---|---|
| EP | 0508817 | | 10/1991 |
| EP | 0474350 | | 3/1992 |
| GB | 1460647 | A | 1/1977 |
| NO | 20042134 | | 11/2005 |
| WO | WO 2004/007894 | | 1/2004 |
| WO | WO 2007/024383 | A2 | 7/2006 |
| WO | 2006109035 | | 10/2006 |
| WO | WO 2006/109035 | A | 10/2006 |
| WO | 2007/024383 | * | 3/2007 |
| WO | WO2008/041010 | A1 | 4/2008 |
| WO | WO2008/142406 | A3 | 11/2008 |

OTHER PUBLICATIONS

U.S. Appl. No. 11/753,314, filed May 24, 2007, Surjaatmadja.

Warpinski, Nonnan R and Branagan, Paul T., "Altered Stress Fracturing", JPT, 990-97, 473-476, Sep. 1989.

Surjaatmadja, "Single Point ofInitiation, Dual-Fracture Placement for Maximizing Well Production," 2007 Society of Petroleum Engineers, SPE 107718.

Surjaatmadja, "The Important Second Fracture and its Operational Placement for Maximizing Production," Society of Petroleum Engineers SPE 107059.

Surjaatmadja, "The Mythical Second Fracture and its Operational Placement for Maximizing Production," Society of Petroleum Engineers SPE 106046.

Information Disclosure Statement for U.S. Appl. No. 11/291,496, Nov. 21, 2006.

International Search Report for International Application No. PCT/GB2007/000677, Jun. 11, 2007.

International Search Report for International Application No. PCT/GB2007/001189, Sep. 5, 2007.

Information Disclosure Statement for U.S. Appl. No. 11/396,918, Oct. 15, 2007.

Information Disclosure Statement for U.S. Appl. No. 11/873,160, Oct. 16, 2007.

International Search Report for International Application No. PCT/GB2008/001044, Aug. 13, 2008.

Office Action for U.S. Appl. No. 11/291,496, dated May 19, 2009.

Office Action for U.S. Appl. No. 11/291,496, dated Mar. 11, 2009.

Office Action for U.S. Appl. No. 11/873,160, dated Oct. 1, 2009.

International Preliminary Report on Patentability from PCT/GB2008/001044, dated Oct. 8, 2009.

Surjaatmadja et al., "Consideration for Future Stimulation Options is Vital in Deciding Horizontal Well Drilling and Completion Schemes for Production Optimization," Society of Petroleum Engineers, 2006, SPE 103774.

Search Report and Written Opinion for International Application No. PCT/GB2008/001730 dated May 21, 2008.

* cited by examiner

METHOD AND SYSTEM FOR CENTRALIZED WELL TREATMENT

FIELD OF THE INVENTION

The present invention relates generally to well operations, and more particularly to methods and systems for simultaneously treating multiple wells from a centralized location and simultaneously connecting multiple wells to a single manifold. This may conserve labor, infrastructure, and environmental impact.

BACKGROUND

In the production of oil and gas in the field, it is often required to treat several well locations with multiple well treatment fluids within a designated amount of time. This treatment processes often involves mobile equipment that is set up and put in place at a pad and then moved by truck from pad to pad within short time periods. Generally, these treatment processes cannot occur simultaneously.

This movement of equipment and personnel can involve complex logistics. The servicing and treatment of wells can require a series of coordinated operations that begin with the supply by truck of equipment, supplies, fuel, and well treatment fluids to the wellhead. The equipment is then set up and made ready with the well treatment fluids. After completion of the well services, equipment must be broken down and made ready for transport to the next pad for service. Often, the next pad will be less than 500 feet away from the previously treated pad. In addition, due to the limited storage capacity of the moving equipment for well treatment fluids and equipment, additional trucks are often required to resupply and reequip an existing operation. This movement of equipment and supplies may have environmental impacts, and the exposure of mobile equipment to adverse weather conditions can jeopardize well treatment operations and worker safety.

SUMMARY

In general, one aspect of the invention features a method for providing well development treatment services to a plurality of wells. The method includes the steps of flowing one or more well development task fluids from a centralized well treatment fluid center to one or more centralized service factories. The centralized service factories are selectively configurable to receive well development task fluids from the centralized well treatment fluid center. The centralized service factories are also selectively configurable to prepare well treatment fluids from the received well development task fluids. The well treatment fluids are flowed from the centralized service factories to at least one of the plurality of wells. The centralized service factories are selectively configurable to recover the flowed well treatment fluids from the plurality of wells and to flow the recovered the well treatment fluids to the centralized well treatment fluid center. The centralized well treatment center is selectively configurable to receive the recovered well treatment fluids.

Another aspect of the invention comprises the steps of disposing of the recovered well treatment fluids at the centralized well treatment fluid center. The centralized well treatment fluid center is selectively configurable to dispose of the recovered well treatment fluids. Another step of the invention comprises reconditioning the recovered well treatment fluids at the centralized well treatment fluid center. The centralized well treatment fluid center is selectively configurable to recondition the recovered well treatment fluids in order to store, dispose or re-flow reconditioned recovered well treatment fluids.

In another aspect of the invention, the recovered well treatment fluids are production fluids. In another aspect of the invention, the well treatment fluids comprise a compound selected from the group consisting of drilling fluid, HALLIBURTON MICROPOLYMER (HMP), cement gas, oil, water, proppant, fracturing fluid, gelling agents, friction reducers, acidizers, conformance fluids, cleaning fluids, brine, cutting abrasives, and proppant and combinations thereof.

Another aspect of the invention features a system for the centralized distributing, receiving, and treating fluids for a plurality of wells. The system includes a centralized well treatment fluid center and one or more centralized service factories. A plurality of distribution lines are coupled between the centralized well treatment fluid center and the centralized service factories. The plurality of distribution lines is adapted to flow one or more well development task fluids. A plurality of return lines are coupled between the centralized well treatment fluid center and the service factories. The plurality of return lines is adapted to flow one or more recovered well treatment fluids. A plurality of modules is disposed about each of the centralized service factories. A first fluid flow line is coupled between at least one of the plurality of wells and any of the plurality of modules. The first fluid flow line is adapted to flow one or more well treatment fluids. A second fluid flow line is coupled between the at least one of the plurality of wells and one or more of the plurality of modules. The second fluid flow line is adapted to recover the well treatment fluids from the at least one of the plurality of wells. A first configuration of the plurality of modules is operable to flow a first well treatment fluid to the at least one of the plurality of wells. A second configuration of the plurality of modules is operable to flow a second well treatment fluid to the at least one of the plurality of wells.

In another aspect of the invention, the modules comprise one or more blending modules. One or more additive storage modules are operable to connect to the blending modules. One or more liquid additive pumps are operable to connect to the blending modules. One or more pumping grids are operable to connect to the blending modules. One or more manifolds are operable to connect to the blending modules. A power grid is operable to connect to the blending modules, the additive storage modules, the liquid additive pumps, the pumping grids and the manifolds.

BRIEF DESCRIPTION OF THE DRAWINGS

A more complete understanding of the present disclosure and advantages thereof may be acquired by referring to the following description taken in conjunction with the accompanying drawings. The drawings illustrate only exemplary embodiments and are not intended to be limiting against the invention.

DETAILED DESCRIPTION

The details of the methods and systems according to the present invention will now be described with reference to the accompanying drawings.

Figure 1:
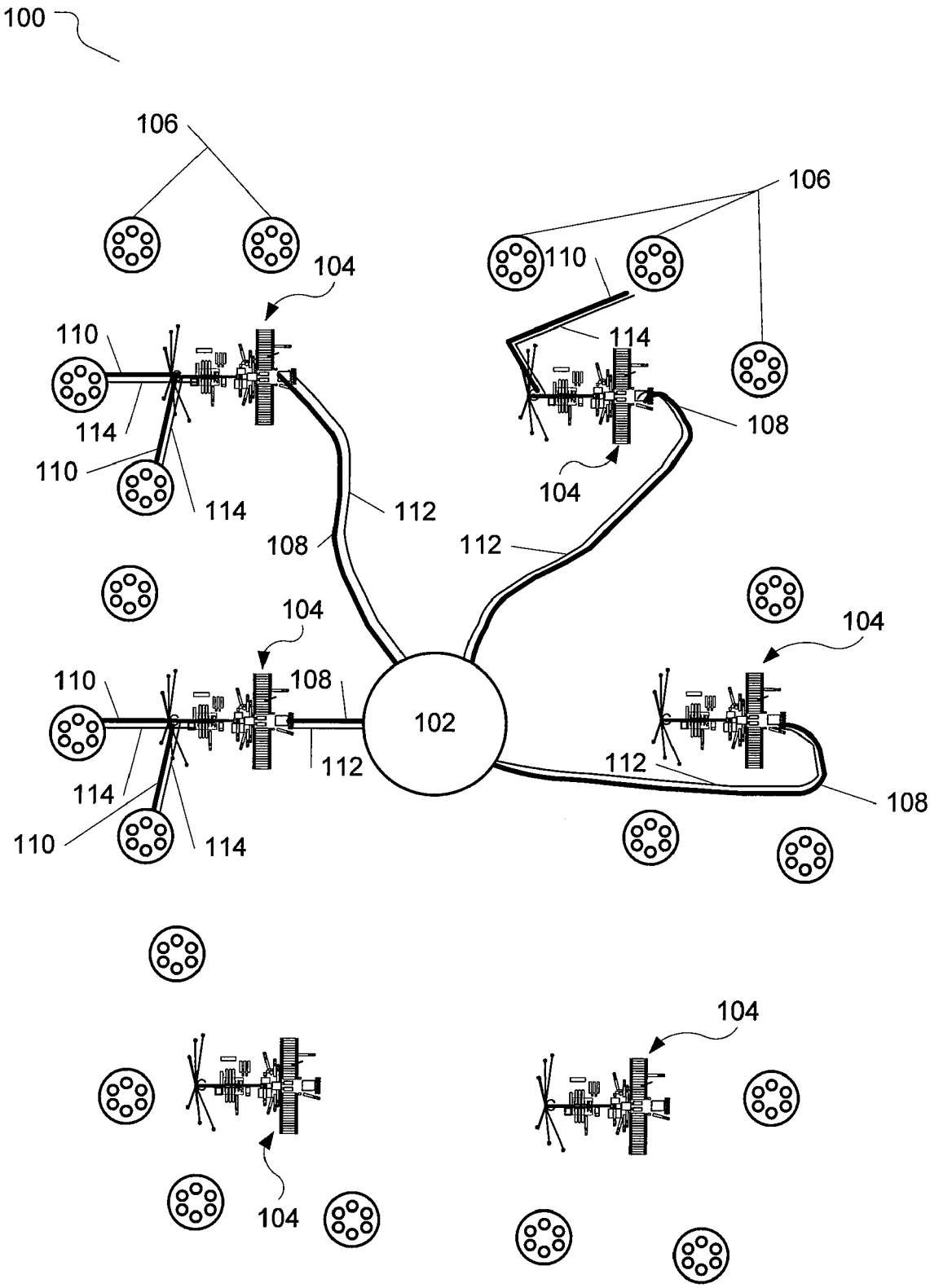
FIG. 1 is a diagram of a system for centralized distributing, receiving, and treating fluids for a plurality of wells.

In reference to FIG. 1, in one embodiment, well development treatment services are provided to a selected oil field shown generally at 100. A centralized well treatment fluid center 102 is located about the selected oil field 100. Though shown centrally located, the centralized well treatment fluid center 102 may be located at any location accessible to the selected oil field 100. The location of the centralized well treatment fluid center 102 may depend upon the characteristics of the surface, subterranean formations, ease of ingress and egress, concentration of the wells to be treated, and any other factors known to one of ordinary skill in the art.

Distribution lines 108 couple the centralized well treatment fluid center 102 to centralized service factories 104. Distribution lines 108 may be adapted to flow well development task fluids from the centralized well treatment fluid center 102 to the centralized service factories 104. The centralized service factories 104 are selectively configurable to use one or more of the received well development task fluids to make well treatment fluids. Return lines 112 may also couple the centralized well treatment fluid center 102 to centralized service factories 104. Return lines 112 may be adapted to flow recovered well treatment fluids or production fluid from the centralized service factories 104 to the centralized well treatment fluid center 102. The centralized service factories 104 are distributed about the oil field 100 in locations that provide efficient treatment to a plurality of wells 106. The location of the centralized service factories 104 may depend upon the characteristics of the surface, subterranean formations, ease of ingress and egress, concentration of wells to be treated, and any other factors known to one of ordinary skill in the art.

The centralized service factories 104 are coupled to one or more of the plurality of wells 106 through first fluid flow lines 110. The centralized service factories 104 are also coupled to one or more of the plurality of wells 106 through second fluid flow lines 114. As shown, in one example embodiment, not all centralized service factories 104 are coupled to the centralized well treatment fluid center 102 simultaneously. A variety of factors may determine which centralized service factories 104 are coupled to the centralized well treatment fluid center 102, such as the availability of equipment, the schedule for a particular grouping of wells, the availability of man-power, as well as other factors known to one of ordinary skill in the art.

The plurality of wells 106 may be contained within a single pad, multiple pads, stand-alone or in any other manner known to one of ordinary skill in the art. One or more fluid flow lines 110, 114 may be coupled between any one of the plurality of wells 106 and any of the centralized service factories 104. As shown, some of the plurality of wells 106 may not be coupled to a centralized service factory 104. A variety of factors may determine which of the plurality of wells 106 are coupled to a centralized service factory 104 such as availability of equipment, treatment schedules, as well as other factors known to one of ordinary skill in the art.

First fluid flow lines 110 may be adapted to flow well treatment fluids from the centralized service factories 104 to the plurality of wells 106. Second fluid flow lines 114 may be adapted to flow recovered well treatment fluids from the plurality of wells 106. Second fluid flow lines 114 may also be adapted to flow production fluids from the plurality of wells 106. Fluid flow lines 110, 114 may also be adapted to flow cleaning fluids. Cleaning fluids may be flowed through any fluid flow lines 110, 114 in order to clear the fluid flow lines 110, 114 of, for example, any buildup or previous residue from a prior well treatment fluid.

The centralized well treatment fluid center 102 and the centralized service factories 104 may be enclosed in a supported fabric structure, a collapsible structure, a prefabricated structure, a retractable structure, a composite structure, a temporary structure, a prefabricated wall and roof structure, a deployable structure, a modular structure, a preformed structure, a mobile accommodation structure, combinations thereof, or any other structure known to one of ordinary skill in the art. The structures forming the enclosures may be permanent or semi-permanent in nature.

Figure 2:
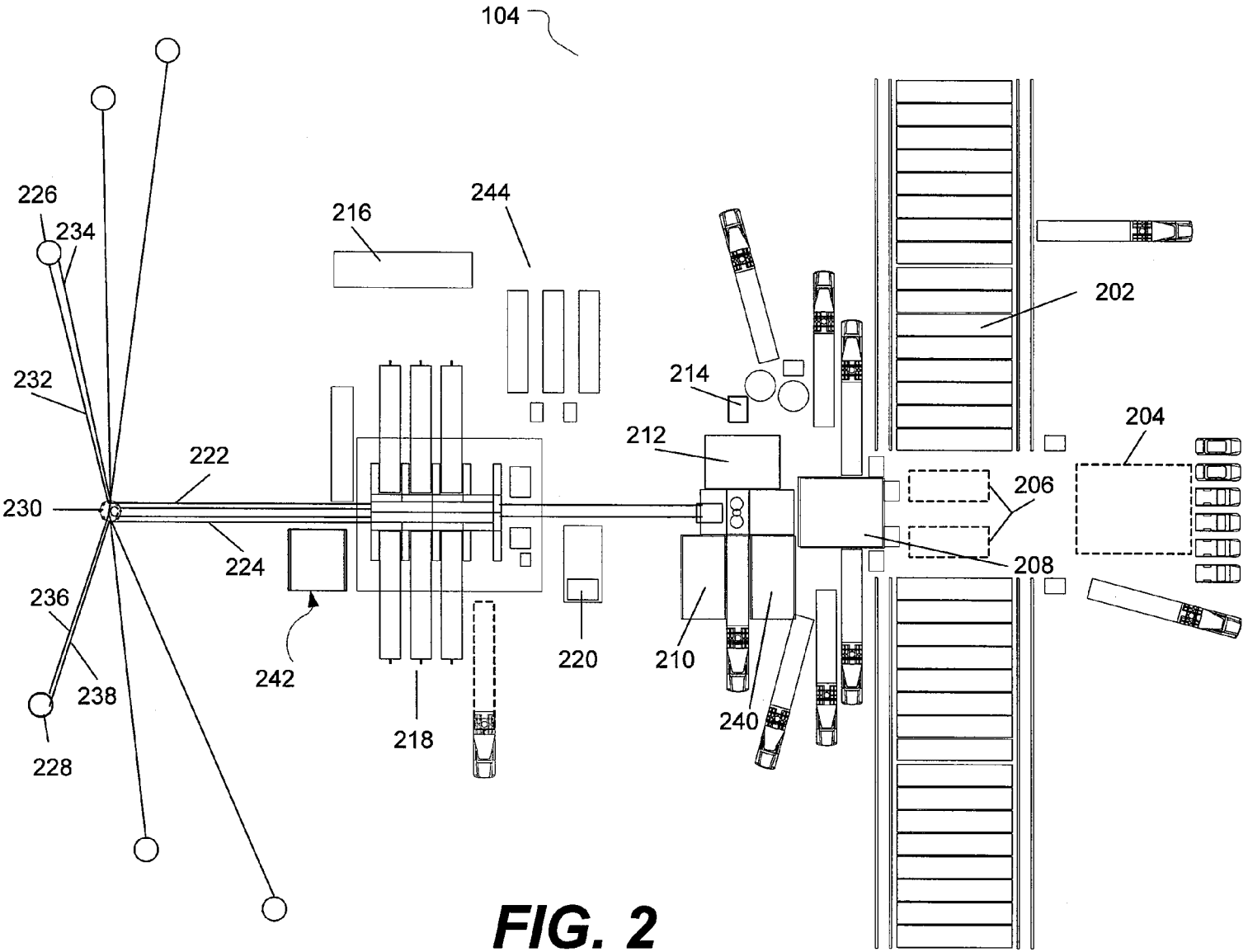
FIG. 2 is a diagram of a centralized service factory.

In reference to FIG. 2, in one embodiment, in general a centralized service factory 104 includes one or more of the following modules: a power grid 244, a fluid treatment center 204, a pumping grid 218, a central manifold 230, a cooling tower 216, water heaters 206, water source 202, blending module 212, heaters 214, liquid additive pumps 208, additive storage module 240, a control house 220, separators 242 and shakers 210. The modules generally comprise the equipment, connections, couplings, and controls necessary to perform a selected well development task. One or more modules may be coupled together to form the necessary configuration of modules for the performance of a selected well development task. Modules may be stored within the centralized service factory 104 or may be transported to a centralized service factory 104 as needed. Some well development tasks may require multiples of the same type of module. One example module may comprise all the necessary equipment to perform a given well development task.

Another example module may comprise equipment plus connections that allow it to be coupled to other modules in order to form a configuration capable of performing a given well development task. In one example embodiment, the modules are mounted on bases that allow the modules to be moved throughout the centralized service factory 104 and to be loaded on a transport for shipment to another location. Many other modules than those depicted in FIG. 2 may be coupled to form a variety of configurations for performing selected well development tasks.

A configuration of modules within the centralized service factory 104 may be connected via the central manifold 230 to at least a first plurality of wells 226, 228 via a first connection 232 and a second connection 234. The connections may be a standard piping or tubing known to one of ordinary skill in the art. The plurality of wells 226, 228 may include well pads containing one or more wellheads.

In one embodiment of the centralized service factory 104, the power grid 244 is centralized and provides electrical power to all of the modules and equipment within the centralized service factory 104 via electrical connections. The power grid 244 can be powered by liquid fuel, natural gas or other equivalent fuel and may optionally be a cogeneration power unit. The power grid 244 may comprise a single trailer with subunits, each subunit with the ability to operate independently. The power grid 244 may also be operable to extend power to one or more outlying wellheads.

In one embodiment, the additive storage module 240 is connected to the blending module 210 and includes automatic valves and a set of tanks that contain well treatment fluids. Each tank can be monitored for level, material weight, and the rate at which the well treatment fluid is being consumed. This information can be transmitted to a controller or control area. Each tank may be capable of being filled pneumatically and can be emptied through a calibrated discharge chute by gravity. Tanks may be added to or removed from the additive storage module 240 as needed. Empty storage tanks may be in the process of being filled by well treatment fluid at the same time full or partially full tanks are being used, allowing for continuous operation. The tanks can be arranged around a calibrated v-belt conveyor.

In one embodiment, the additive storage module 240 comprises tanks filled with proppant. In addition, a resin-coated proppant may be used by the addition of a mechanical proppant coating system, not shown in FIG. 2. For example, the coating system may be a proppant coating system sold under the trademark MULLER SYSTEM.

In another embodiment, part of the additive storage module 240 may be a chemical storage module. This chemical storage module is connected to the blending module 210 and may comprise tanks filled with chemicals. The chemicals may include breakers, gel additives, crosslinkers, and liquid gel concentrate. The tanks may have level control systems such as a wireless hydrostatic pressure system and may be insulated and heated by heaters 214. Pressurized tanks may be used to provide positive pressure displacement to move chemicals, and some tanks may be agitated and circulated. The chemical storage module may be equipped to continuously meter chemicals through the use of additive pumps which may be able to meter chemical solutions to the blending module 210 at specified rates as determined by the required final concentrations and the pump rates of the main treatment fluid from the blending module. Chemical storage tanks may be pressurized to drive fluid flow. The quantities and rates of chemicals added to the main fluid stream are controlled by valve-metering control systems. In addition, chemical additives could be added to the main treatment fluid via aspiration (Venturi Effect). The rates that the chemical additives are aspirated into the main fluid stream can be controlled via adjustable, calibrated apertures located between the chemical storage tank and the main fluid stream. In the case of fracturing operations, the main fluid stream may be either the main fracture fluid being pumped or may be a slip stream off of a main fracture fluid stream. In one embodiment, the components of the chemical storage module are modularized allowing pumps, tanks, or blenders to be added or removed independently.

In yet another embodiment, the blending module 212 is connected to the additive storage module 240, the water source 202, and the pumping grid 218 and may prepare a fracturing fluid, complete with proppant and chemical additives or modifiers, by mixing and blending fluids and chemicals at continuous rates according to the needs of a well formation. The blending module 212 may include a preblending unit wherein water is fed from water source 202. A dry powder (guar) may be metered from a storage tank by way of a screw conveyor into the preblender's fluid stream where it is mixed with water and blended with various chemical additives and modifiers provided by the additive storage module 240. These chemicals may include crosslinkers, gelling agents, viscosity altering chemicals, PH buffers, modifiers, surfactants, breakers, and stabilizers. This mixture is fed into the blending module's hydration device, which provides a first-in-first-out laminar flow. This now near fully hydrated fluid stream is blended in the mixer of the blending module 212 with proppant stored in the additive storage module 240 to create a final fracturing fluid. This process can be accomplished at downhole pump rates. In one embodiment, the mixing apparatus is a modified Halliburton Growler mixer modified to blend proppant and chemical additives to the base fluid without destroying the base fluid properties but still providing ample energy for the blending of proppant into a near fully hydrated fracturing fluid. The final fluid can be directed to a pumping grid 218 and subsequently directed to a central manifold 230, which can connect and direct the fluid via connections 232 and 236 to multiple wells 226 and 228 simultaneously.

In one embodiment, the means for simultaneously flowing well treatment fluid is the central manifold 230. The central manifold 230 may be a module that comprises one or more manifolds or may be multiple modules where each module comprises one or more manifolds. The type of configuration for the central manifold 230 may depend upon a selected well development task. The central manifold 230 is connected to the pumping grid 218 and is operable to flow well treatment fluid, for example, to multiple wells at different pads simultaneously. The well treatment fluid may comprise proppant, gelling agents, friction reducers, reactive fluid such as hydrochloric acid, drilling fluid, HMP, cement, gas, oil, water, fracturing fluid, acidizers, conformance fluids, cleaning fluids, brine, cutting abrasives and combinations and can be aqueous or hydrocarbon based. The manifold 230 is operable to treat simultaneously two separate wells via connections 232 and 236. In this example, multiple wells may be treated simultaneously, or a well treatment fluid may be flowed simultaneously to multiple wells 226, 228. The well treatment fluid flowed may be of the same composition or different composition. These flows can be coordinated depending on a well's specific treatment needs. In addition, connections 234 and 238 between the central manifold 230 and multiple wells 226 and 228 may be used in the opposite direction to recover the well treatment fluid.

Recovered treatment fluid may be flowed from the central manifold 230 to the fluid treatment center 204 via couplings. In one embodiment, the recovered treatment fluid may comprise a production fluid, such as water or hydrocarbons. The fluid treatment center 204 may comprise a production fluid module where the recovered production fluid can be stored or processed. In another embodiment, the fluid treatment center 204 includes a reconditioning module. The reconditioning module allows components of recovered well treatment fluids to be reused. The recovered treatment fluids may also be flowed substantially simultaneously with recovery to the centralized well treatment fluid center 104 for disposal, reconditioning, transportation, or storage.

In one embodiment, a fluid flow line 222 is coupled between the pumping grid 218 and the manifold 230 in order to flow the well treatment fluid to fluid flow lines 232 and 236. Well treatment fluid recovered from pads 226 and 228 may then be pumped through lines 238 and 234 to the manifold 230 which may be coupled to a return fluid flow line 224. The fluid lines 222 and 224 allow for substantially simultaneous well treatment and recovery of well treatment fluids. In a certain embodiment, a plurality of pumps may be connected to the plurality of manifolds 230.

In some embodiments, the operations of the modules are controlled, coordinated, and monitored by the central control module 220. The central control module 220 may use all of the sensor data from all modules and the drive signals from their individual subcontrollers to determine subsystem trajectories. For example, control over the manufacture, pumping, gelling, blending, and resin coating of proppant by the control system can be driven by desired product properties such as, but not limited to, density, rate, and viscosity. Control can also be driven by external factors affecting the subunits such as dynamic or steady-state bottlenecks. The central control module 220 can include such features as: (1) virtual inertia, whereby the rates of the subsystems (chemical, proppant, power, etc.) are coupled despite differing individual responses; (2) backward capacitance control, whereby the tub level controls cascade backward through the system; (3) volumetric observer, whereby sand rate errors are decoupled and proportional ration control is allowed without steady-state error. The central control module 220 can also be used to monitor equipment health and status.

Figure 3:
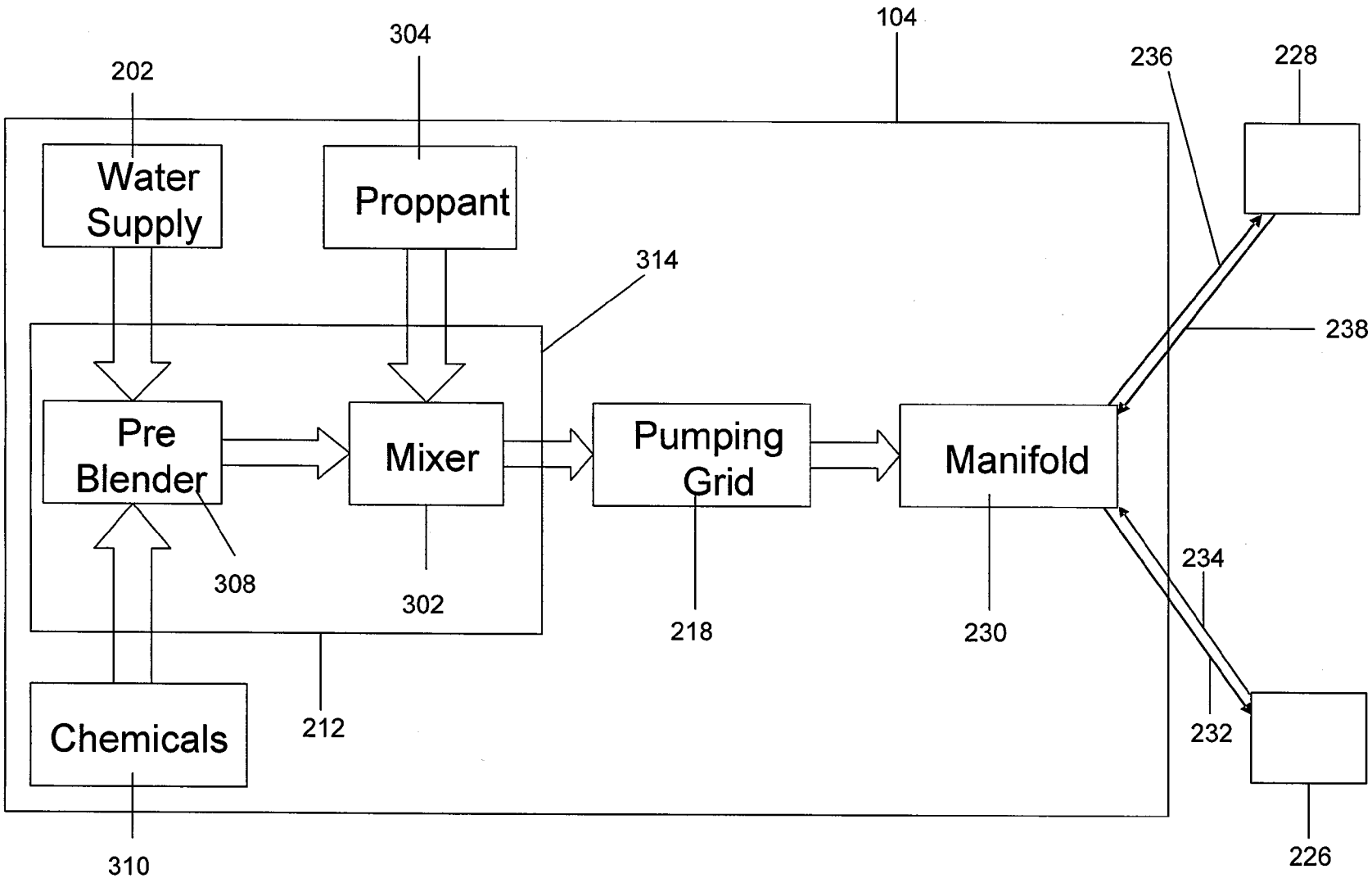
FIG. 3 is a flow diagram of modules in a centralized service factory.

In reference to FIG. 3, in one embodiment, the centralized service factory 104 is configured to flow fracturing fluid. The blending module 212 is connected to a chemical storage module 310, a proppant storage module 304, a water source 202, and the pumping grid 218 and may prepare a fracturing fluid, complete with proppant and chemical additives or modifiers, by mixing and blending fluids and chemicals at continuous rates according to the needs of a well formation. The blending module 212 comprises a preblending unit 308 wherein water is fed from the water source 202 and dry powder (guar) or liquid gel concentrate can be metered from a storage tank by way of a screw conveyor or pump into the preblender's fluid stream where it is mixed with water and blended with various chemical additives and modifiers provided by the chemical storage system 310. The dry powder (guar) or liquid gel concentrate may comprise separate systems or may be combined into a single system. These chemicals may include crosslinkers, gelling agents, viscosity altering chemicals, PH buffers, modifiers, surfactants, breakers, and stabilizers. This mixture is fed into the blending module's hydration device, which provides a first-in-first-out laminar flow. This now near fully hydrated fluid stream is blended in a mixer 302 of the blending module 212 with proppant from the proppant storage system to create the final fracturing fluid. This process can be accomplished at downhole pump rates. The blending module may be modularized allowing its components to be easily replaced or for its components to each form a separate system. In one embodiment, the mixer 302 is a modified Halliburton GROWLER mixer modified to blend proppant and chemical additives to the base fluid without destroying the base fluid properties but still providing ample energy for the blending of proppant into a near fully hydrated fracturing fluid. The final fluid, fracturing fluid, can be directed to the pumping grid 218 and subsequently directed to the central manifold 230, which can connect and direct the fracturing fluid via connection 236 and 232 to multiple wells 228 and 226 simultaneously. In one embodiment, multiple blending modules may comprise a single system or may comprise multiple systems that are coupled together. Fluid flow lines 232, 238 may be used to recover the flowed fracturing fluid.

The present invention may be used both for onshore and offshore operations using existing or specialized equipment or a combination of both. Such equipment can be modularized to expedite installation or replacement.

Figure 4:
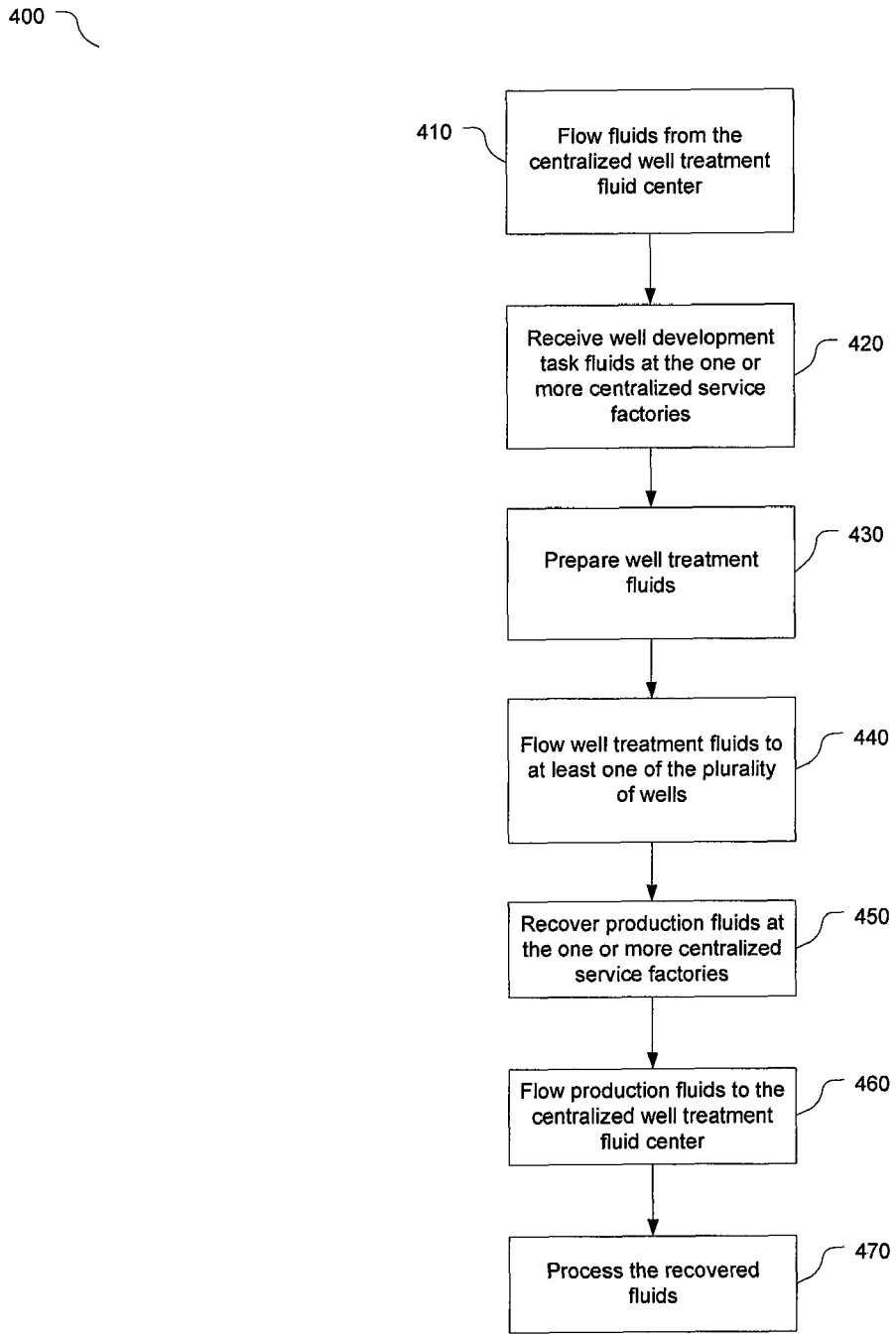
FIG. 4 is a flow chart of a method for providing centralized well development services to a plurality of wells.

FIG. 4 is a flow chart of an example method for providing centralized well development services to a plurality of wells shown generally at 400. The first step is to flow fluids from the centralized well treatment fluid center 410. Next, receive well development task fluids at the one or more centralized service factories 420. Prepare well treatment fluids 430. Flow well treatment fluids to at least one of the plurality of wells 440. Recover production fluids at the one or more centralized service factories 450. Flow production fluids to the centralized well treatment fluid center 460. Process the recovered fluids 470.

In one example embodiment, the fluids in 410 are well development task fluids. The type of well development task fluid depends in part on the type of treatment to be performed on the plurality of wells. The centralized service factories may be configured to receive the well development task fluids. The configuration for receiving the well development task fluids may include coupling modules necessary to receive the well development task fluids, process and prepare well treatment fluids from the well development task fluids and flow the well treatment fluids to the plurality of wells. In one embodiment, the well development task fluids flowed from the centralized well treatment fluid center are well treatment fluids, in which case the preparation step 430 may not be necessary.

The recovered fluids in step 450 may be well treatment fluids, production fluids, water or any other fluid recoverable from a well known to one of ordinary skill in the art. The centralized service factories 104 may be configured to receive any type of recovered fluids. In one example embodiment, production fluids are recovered using a first return fluid flow line while well treatment fluids are recovered using a second return fluid flow line.

Figure 5:
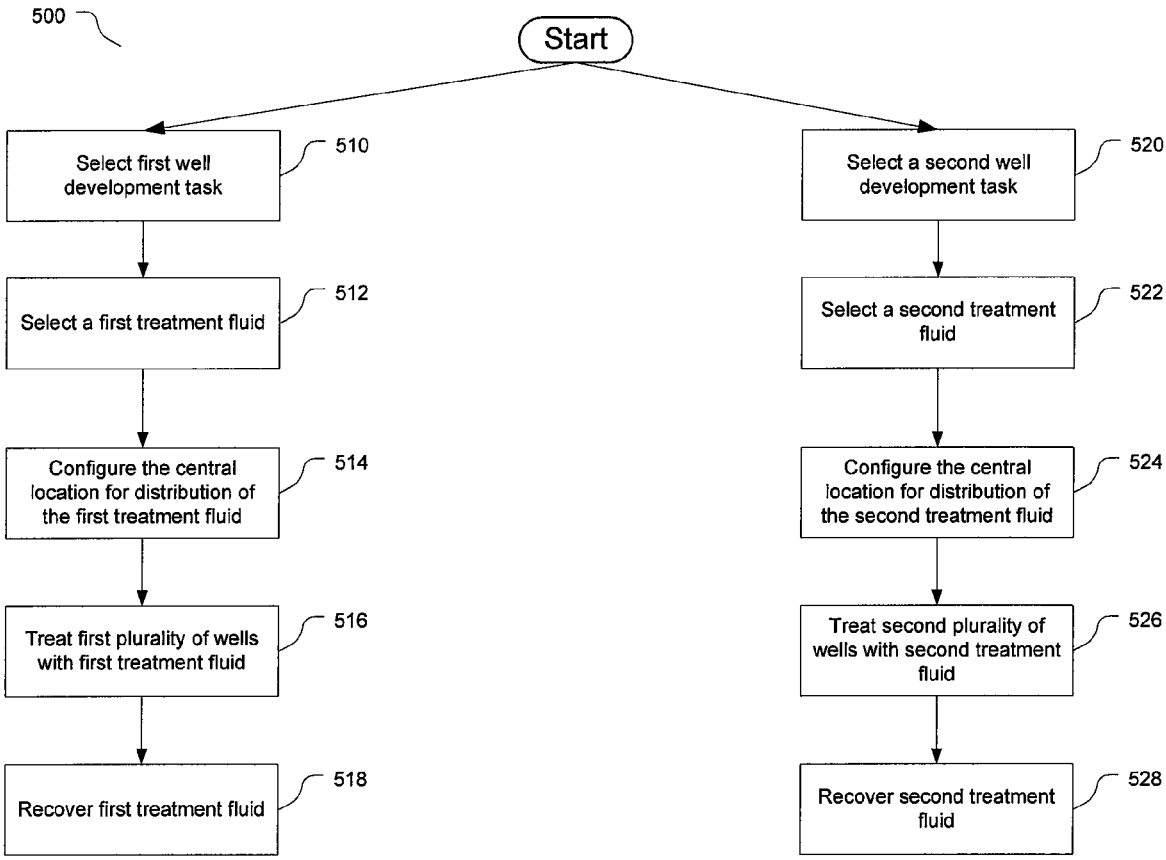
FIG. 5 is a flow chart of a method for providing centralized well development services to at least two wells of a plurality of wells.

FIG. 5 is a flow chart of an example method for treating multiple wells from a centralized service factory shown generally at 500. The first step is to select first well development task 510. Select a first treatment fluid 412. Configure the central location for distribution of the first treatment fluid 514. Treat first plurality of wells with first treatment fluid 516. Recover first treatment fluid 518. Step 520 is to select a second well development task. Select a second treatment fluid 522. Configure the central location for distribution of the second treatment fluid 524. Treat second plurality of wells with second treatment fluid 526. Recover second treatment fluid. Steps 520 through 528 may occur substantially simultaneously with steps 510-518. In one embodiment, these steps directed to the first plurality of wells and the second plurality of wells is performed substantially simultaneously with each other.

In one example embodiment, separate fluid flow lines are coupled between the first plurality of wells to the centralized service factory 500 and the second plurality of wells to the centralized service factory 500. Separate fluid flow lines may be coupled between the first plurality of wells and the centralized service factory 500 for recovery of the well treatment fluid. Separate fluid flow lines may be coupled between the second plurality of well and the centralized service factory 500 for recovery of the well treatment fluid. Valves may be used to couple the fluid flow lines to allow for substantially simultaneous flow and recovery of well treatment fluid. In another embodiment, each plurality of wells may have dedicated back-up lines or safety lines.

Each of the fluid flow lines is interchangeable in that they may receive various types of fluids. Before receiving a different type of fluid, a fluid flow line may require line cleanup which is often achieved using pipeline "pigs". Pipeline "pigs" are fluid separating devices that are pumped through the fluid flow line for the purpose of cleaning the fluid line of the previous flowed fluid in order to minimize unwanted mixing effects.

Figure 6:
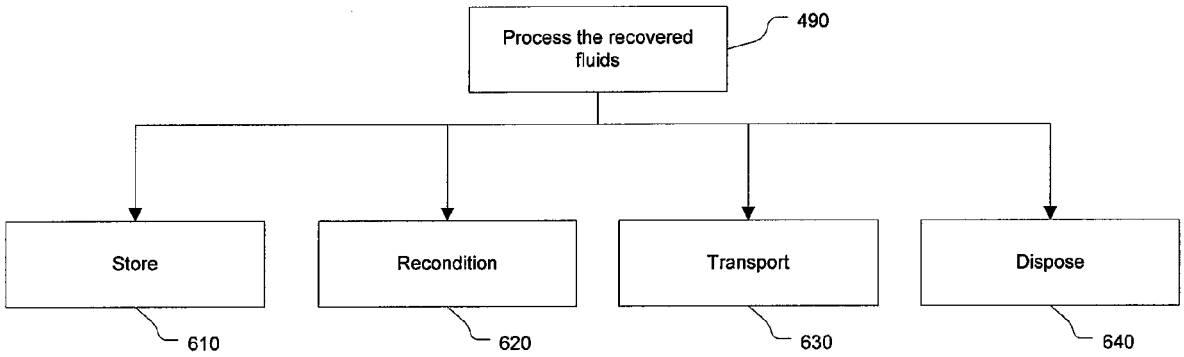
FIG. 6 is a flow chart of a method for processing recovered fluids according to one exemplary embodiment.

In reference to FIG. 6, in one embodiment, the first step is to process the recovered fluids 490 at the centralized well treatment fluid center. The next step is to store fluids 610, recondition 620, transport 630 and dispose of 640 the recovered fluids in step 490. Steps 610, 620, 630, and 640 may not all be implemented for the recovered fluids in step 490. The steps 610, 620, 630 and 640 implemented for the recovered fluids in 490 is based, at least in part, on the type of recovered fluid. As those of ordinary skill in the art will appreciate, many factors may contribute to the decision to implement any of the steps 610, 620, 630 and 640.

In one example embodiment, the centralized well treatment fluid center may be configured to store 610 any recovered fluids received. The stored fluids may be reconditioned for later use for another well treatment service or transported off site for further processing. Stored fluids may also be disposed of on site or transported off site during, for instance, a bulk removal process.

In one example embodiment, the centralized well treatment fluid center may be configured to recondition 620 any recovered fluids received. The reconditioned fluids may be flowed from the centralized well treatment fluid center to a centralized service factory. The reconditioning of the reconditioned fluids may occur substantially simultaneously with receiving the recovered fluids from the centralized service factory.

In one example embodiment, the centralized well treatment fluid center may be configured to transport 630 any recovered fluids received. The recovered fluids may be stored in tankers for transportation substantially simultaneously with receipt of the recovered fluids or for transport at a later time. In one example embodiment, the recovered fluid is production fluid which may be stored on site temporarily or transported directly to another facility. Transport of fluids may be accomplished through the use of tanker trucks, other fluid flow lines, railcar or any other method known to one of ordinary skill in the art.

In one example embodiment, the centralized well treatment fluid center may be configured to dispose of 640 any recovered fluids received. Fluids allocated for disposal may be flowed to the centralized well treatment fluid center from the centralized service factories so as to create a centralized repository in order to reduce any environmental risks.

Figure 7:
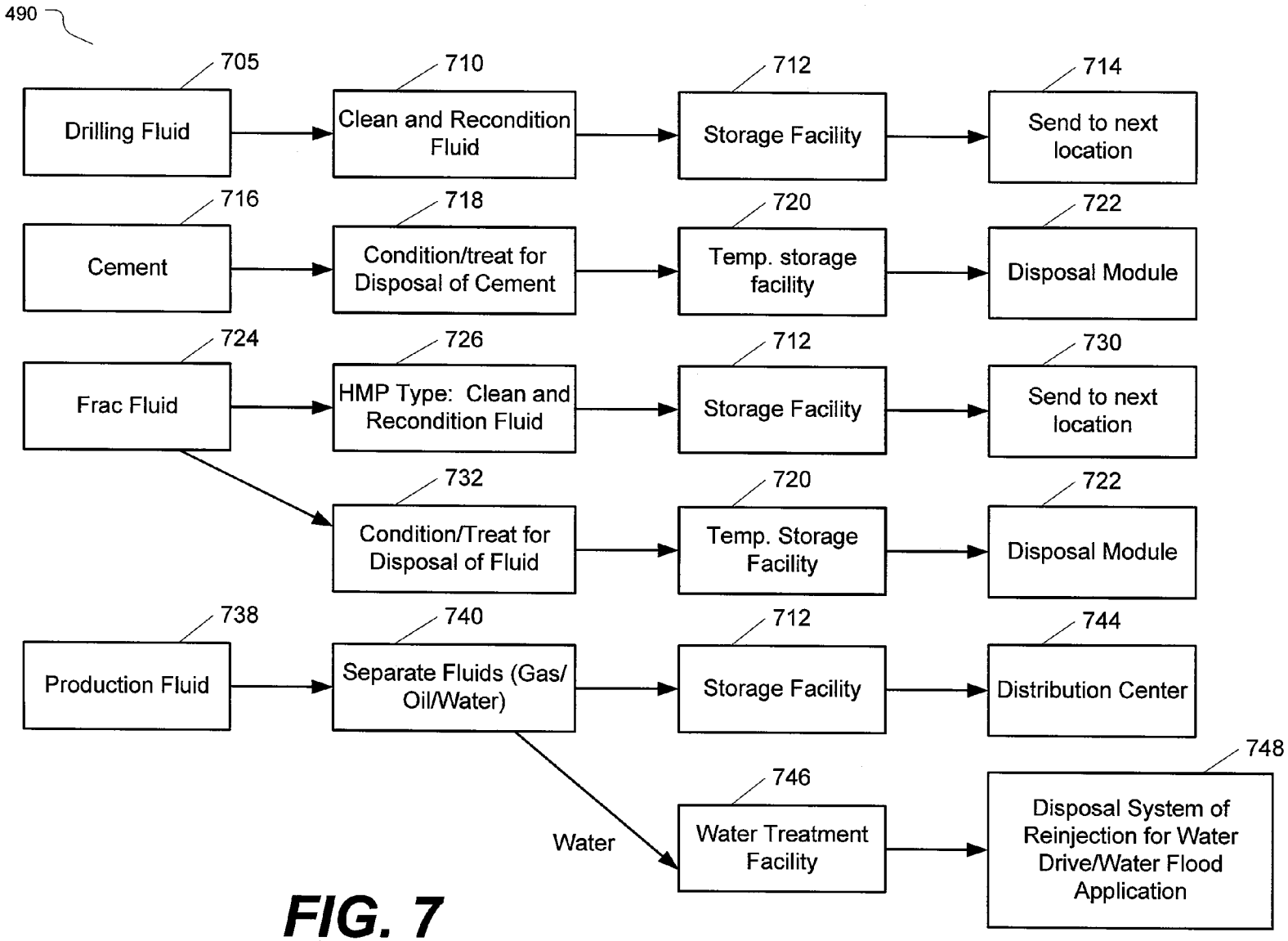
FIG. 7 is a flow chart of a method for processing recovered fluids according to one exemplary embodiment.

In reference to FIG. 7, in one embodiment, the step of processing fluids 490 at the centralized well treatment fluid center may include processing drilling fluid 705, cement 716, fracturing fluid 724, and production fluid 738. The step of processing drilling fluid 705 may include configuring one or more modules to clean and recondition the drilling fluid 710. The drilling fluid may be stored in a storage facility 712 such as a storage module 240. The drilling fluid may be sent to another location 714 for permanent storage or re-use. The drilling fluid may also be sent for further treatment of the current well or for treatment of another well.

The step of processing cement 716 may include configuring one or more modules to condition or treat the cement for disposal 718. The cement may be temporarily stored 720 such as in the storage module 240. The cement may then be sent to a disposal module 722 for temporary or permanent disposal.

The step of processing fracturing fluid 724 may include configuring one or more modules to clean and recondition the fracturing fluid 726. The cleaned and reconditioned fracturing fluid may be stored in a storage facility 712 such as a storage module 240. The fracturing fluid may be stored in a storage facility 712 such as a storage module 240. The fracturing fluid may be sent to another location 714 for permanent storage or re-use. The fracturing fluid may also be sent for further treatment of the current well or for treatment of another well. The fracturing fluid may also be conditioned and treated for disposal 732. The fracturing fluid may then be stored in a temporary storage facility 720 such as a storage module 240. The fracturing fluid may then be sent to a disposal module 722 for temporary or permanent disposal.

The step of processing production fluid 738 may include one or more modules to separate the production fluids into two or more second production fluids. The two or more second production fluids may comprise oil, gas and water. The two or more second production fluids are sent to a storage facility 712 such as a storage module. The two or more second production fluids may then be sent to a distribution center 722 for further processing and refinement. At least one of the two or more second production fluids may comprise water which may be sent to a water treatment facility 748 such as a water treatment module. The treated water may then be sent for disposal or to a system for reinjection for water drive or a water flood application 748.

As those of ordinary skill in the art will appreciate, the present invention can be adapted for multiple uses. By way of example only, multiple well sites may be treated, produced, or treated and produced sequentially or simultaneously from a single central location. The invention is capable of considerable additional modification, alteration, and equivalents in form and function, as will occur to those ordinarily skilled in the art having the benefit of this disclosure. The depicted and described embodiments of the invention are exemplary only, and are not exhaustive of the scope of the invention. Consequently, the invention is intended to be limited only by the spirit and scope of the appended claims.

What is claimed is:

1. A method of providing centralized well development services to a plurality of wells, comprising the steps of:

flowing from a centralized well treatment fluid center to one or more centralized service factories one or more well development task fluids, wherein the one or more centralized service factories are selectively configurable to receive the one or more well development task fluids;

preparing, at the one or more centralized service factories, one or more well treatment fluids from the one or more well development task fluids, wherein the one or more centralized service factories are selectively configurable to prepare the one or more well treatment fluids;

flowing from the one or more centralized service factories to at least one of the plurality of wells the one or more well treatment fluids, wherein the one or more centralized service factories are selectively configurable to flow the one or more well treatment fluids;

recovering from the at least one of the plurality of wells the one or more well treatment fluids at the one or more centralized service factories, wherein the one or more centralized service factories are selectively configurable to receive the one or more recovered well treatment fluids; and flowing from the one or more centralized service factories to the centralized well treatment fluid center the one or more recovered well treatment fluids, wherein the one or more centralized service factories are selectively configurable to flow the one or more recovered well treatment fluids, and wherein the centralized well treatment fluid center is selectively configurable to receive the one or more recovered well treatment fluids.

2. The method of claim 1, wherein at least two well development task fluids are provided and they comprise different compositions.

3. The method of claim 1, further comprising the step of:

disposing of at least one of the one or more recovered well treatment fluids at the centralized well treatment fluid center, wherein the centralized well treatment fluid center is configurable to dispose of the at least one of the one or more recovered well treatment fluids.

4. The method of claim 1, further comprising the step of:

reconditioning at least one of the one or more recovered well treatment fluids at the centralized well treatment fluid center, wherein the centralized well treatment fluid center is configurable to recondition the at least one of the one or more recovered well treatment fluids.

5. The method of claim 1, wherein at least one of the one or more well treatment fluids comprises a compound selected from the group consisting of drilling fluid, HMP, cement, gas, oil, water, proppant, fracturing fluid, gelling agents, friction reducers, acidizers, conformance fluids, cleaning fluids, brine, cutting abrasives and combinations thereof.

6. The method of claim 1, further comprising the steps of:

receiving a production fluid at one or more of the one or more centralized service factories from the at least one of the plurality of wells, wherein the one or more of the one or more centralized service factories is configurable to receive the production fluid; and receiving the production fluid at the centralized well treatment fluid center from the one or more of the one or more centralized service factories, wherein the centralized well treatment fluid center is configurable to receive the production fluid from the one or more of the one or more centralized service factories.

7. The method of claim 6, further comprising the step of:

separating the production fluid into at least two or more second production fluids, wherein the centralized well treatment fluid center is configurable to separate the production fluid into at least two or more second production fluids.

8. The method of claim 7, further comprising the steps of:

conditioning the at least two or more second production fluids, wherein the centralized well treatment fluid center is configurable to condition the at least two or more second production fluids; and disposing of at least one of the at least two or more second production fluids, wherein the centralized well treatment fluid center is configurable to dispose of the at least one of the at least two or more second production fluids.

9. The method of claim 7, further comprising:

flowing the at least two or more second production fluids to a distribution center, wherein the centralized well treatment fluid center is configurable to flow the at least two or more second production fluids to the distribution center.

10. The method of claim 1, further comprising the steps of:

flowing from the centralized well treatment fluid center to the one or more centralized service factories one or more other well development task fluids, wherein the one or more centralized service factories are selectively configurable to receive the one or more other well development task fluids;

flowing from the one or more centralized service factories to the at least one of the plurality of wells the one or more other well treatment fluids, wherein the one or more centralized service factories is selectively configurable to flow the one or more other well treatment fluids;

recovering from the at least one of the plurality of wells the one or more other well treatment fluids at the one or more centralized service factories, wherein the one or more centralized service factories are selectively configurable to receive the one or more recovered other well treatment fluids; and flowing from the one or more centralized service factories to the centralized well treatment fluid center the one or more other recovered well treatment fluids, wherein the one or more centralized service factories are selectively configurable to flow the one or more other recovered well treatment fluids, and wherein the centralized well treat fluid center is selectively configurable to receive the one or more other recovered well treatment fluids.

11. The method of claim 1, further comprising the step of:

storing the one or more recovered well treatment fluids at the centralized well treatment fluid center, wherein the centralized well treatment fluid center is configurable to store the one or more recovered well treatment fluids.

12. The method of claim 1, further comprising the step of:

flowing from the centralized well treatment fluid center substantially simultaneously two or more well development task fluids to at least one of the one or more centralized service factories, wherein the centralized well treatment fluid center is configurable to flow substantially simultaneously the two or more well development task fluids, and wherein the at least one of the one or more centralized service factories are configurable to receive substantially simultaneously the two or more well development task fluids.

13. The method of claim 12, further comprising the step of:

flowing to a first well of the plurality of wells from the at least one of the one or more centralized service factories any of the one or more well treatment fluids prepared from the two or more well development task fluids substantially simultaneously with flowing to a second well of the plurality of wells from the at least one of the one or more centralized service factories any of the one or more well treatment fluids prepared from the two or more well development task fluids, wherein the at least one of the one or more centralized service factories is configurable to flow substantially simultaneously at least two of the one or more well treatment fluids.

14. The method of claim 1, further comprising the step of:

flowing from the centralized well treatment fluid center to the one or more centralized service factories the one or more well treatment fluids, wherein the one or more centralized service factories are selectively configurable to receive the one or more well treatment fluids.

15. The method of claim 1, further comprising the steps of:

flowing to two or more wells of the plurality of wells substantially simultaneously the one or more well treatment fluids from at least one of the one or more centralized service factories, wherein the at least one of the one or more centralized service factories is configurable to flow substantially simultaneously the one or more well treatment fluids to the two or more wells of the plurality of wells; and recovering from the two or more wells of the plurality of wells substantially simultaneously the one or more well treatment fluids at the at least one of the one or more centralized service factories, wherein the at least one of the one or more centralized service factories is configured to recover substantially simultaneously the one or more well treatment fluids.

16. The method of claim 1, further comprising the steps of:

providing a first plurality of fluid lines from the centralized well treatment fluid center to a first centralized service factory, wherein the first plurality of fluid lines are adapted to flow the one or more well treatment fluids;

providing a second plurality of fluid lines from the centralized well treatment fluid center to the first centralized service factory, wherein the second plurality of fluid lines are adapted to flow the one or more recovered well treatment fluids;

providing a third plurality of fluid lines from the centralized well treatment fluid center to a second centralized service factory, wherein the third plurality of fluid lines are adapted to flow the one or more well treatment fluids; and providing a fourth plurality of fluid lines from the centralized well treatment fluid center to the second centralized service factory, wherein the fourth plurality of fluid lines are adapted to flow the one or more recovered well treatment fluids.

17. A system for centralized distributing, receiving, and treating fluids for a plurality of wells, the system comprising:

a centralized well treatment fluid center;

one or more centralized service factories;

a plurality of distribution lines coupled between the centralized well treatment fluid center and the one or more centralized service factories, wherein the plurality of distribution lines are adapted to flow one or more well development task fluids; and a plurality of return lines coupled between the centralized well treatment fluid center and the one or more centralized service factories, wherein the plurality of return lines are adapted to flow one or more recovered well treatment fluids.

18. The system of claim 17, further comprising:

a plurality of modules disposed about each of the one or more centralized service factories;

a first fluid flow line coupled between the at least one of the plurality of wells and any of the plurality of modules, wherein the first fluid flow line is adapted to flow one or more well treatment fluids to the at least one of the plurality of wells; and a second fluid flow line coupled between the at least one of the plurality of wells and one or more of the plurality of modules, wherein the second fluid flow line is adapted to recover the one or more well treatment fluids from the at least one of the plurality of wells;

wherein a first configuration of the plurality of modules is operable to flow a first well treatment fluid to the at least one of the plurality of wells; and wherein a second configuration of the plurality of modules is operable to flow a second well treatment fluid to the at least one of the plurality of wells.

19. The system of claim 18, wherein at least one of the one or more modules is directed to reconditioning the one or more well treatment fluids substantially simultaneously with recovering the one or more well treatment fluids.

20. The system of claim 18, further comprising a disposal module coupled to at least one of the one or more modules, wherein the disposal module is operable to dispose of the recovered well treatment fluids.

21. The system of claim 18, further comprising a base coupled to at least one of the one or more modules, wherein the base is operable to move the at least one of the one or more modules.

22. The system of claim 18, further comprising a cleaning module coupled to at least one of the one or more modules, wherein the cleaning module is operable to clean any fluid flow line.

23. The system of claim 18, further comprising a production fluid module, wherein the production fluid module is operable to receive production fluid from at least one of the one or more centralized service factories.

24. The system of claim 17, wherein each of the plurality of distribution lines are adapted to flow one or more well treatment fluids.

25. The system of claim 17, wherein the centralized well treatment center is configurable to:

flow the one or more well development task fluids;

receive the one or more recovered well treatment fluids;

recondition the one or more recovered well treatment fluids; and receive production fluids.

26. The system of claim 17, wherein the one or more centralized service factories is configurable to:

receive the one or more well development task fluids from the centralized well treatment fluid center;

prepare the one or more well treatment fluids from the one or more well development task fluids;

flow the one or more well treatment fluids to the plurality of wells;

receive the one or more recovered well treatment fluids from the plurality of wells; and receive production fluids from the plurality of wells.

27. The system of claim 17, wherein the plurality of modules comprise:

one or more blending modules;

one or more additive storage modules, wherein the one or more additive storage modules are operable to connect to the one or more blending modules;

one or more liquid additive pumps, wherein the one or more liquid additive pumps are operable to connect to the one or more blending modules;

one or more pumping grids, wherein the one or more pumping grids are operable to connect to the one or more blending modules;

one or more manifolds, wherein the one or more manifolds are operable to connect to the one or more blending modules; and a power grid, wherein the power grid is operable to connect to the one or more blending modules, the one or more additive storage modules, the one or more liquid additive pumps, the one or more pumping grids, and the one or more manifolds.

28. The system of claim 27, further comprising:

a third fluid flow line between at least one of a second plurality of wells and the one or more manifolds, wherein the third fluid flow line is directed to delivering at least one of the one or more well treatment fluids;

wherein the one or more manifolds is operable to deliver substantially simultaneously any of the one or more well treatment fluids through the third fluid flow line and any of the one or more well treatment fluids through the second fluid flow line; and a fourth fluid flow line between the second plurality of wells and the one or more manifolds, wherein the fourth fluid flow line is directed to recovering the one or more well treatment fluids from the at least one of the second plurality of wells.

29. The system of claim 28, further comprising:

a fluid reconditioning module disposed about the centralized well treatment fluid center, wherein the fluid reconditioning module is operable to recondition at least one of the one or more recovered well treatment fluids; and a fifth fluid flow line between the fluid reconditioning module and the third fluid flow line so as to receive the one or more recovered well treatment fluids from the at least one of the one or more centralized service factories.

30. The system of claim 29, further comprising:

a sixth fluid flow line between the fluid reconditioning module and any of the one or more modules so as to flow the reconditioned well treatment fluids to the one or more centralized service factories.

31. The system of claim 30, further comprising:

a seventh fluid flow line between the fluid reconditioning module and an additive storage module, wherein the additive storage module is operable to store the reconditioned well treatment fluids.

* * * * *